US011837813B2

(12) United States Patent
Scherer et al.

(10) Patent No.: US 11,837,813 B2
(45) Date of Patent: Dec. 5, 2023

(54) MULTI-POLE ELECTRICAL PLUG-IN CONNECTOR

(71) Applicant: KOSTAL Kontakt Systeme GmbH, Luedenscheid (DE)

(72) Inventors: Thomas Scherer, Luedenscheid (DE); Dennis Gazke, Breckerfeld (DE); Stephane Michaud, Breval (FR); Andreas Scheib, Schwerte (DE)

(73) Assignee: KOSTAL Kontakt Systeme GmbH, Luedenscheid (DE)

( * ) Notice: Subject to any disclaimer, the term of this patent is extended or adjusted under 35 U.S.C. 154(b) by 178 days.

(21) Appl. No.: 17/475,426

(22) Filed: Sep. 15, 2021

(65) Prior Publication Data

US 2021/0408714 A1 Dec. 30, 2021

Related U.S. Application Data

(63) Continuation of application No. PCT/EP2020/059603, filed on Apr. 3, 2020.

(30) Foreign Application Priority Data

Apr. 10, 2019 (DE) ..... 10 2019 002 660.8

(51) Int. Cl.
*H01R 13/434* (2006.01)
*H01R 13/41* (2006.01)
(Continued)

(52) U.S. Cl.
CPC ..... *H01R 13/434* (2013.01); *H01R 13/41* (2013.01); *H01R 13/4362* (2013.01); *H01R 2107/00* (2013.01)

(58) Field of Classification Search
CPC .... H01R 13/41; H01R 13/434; H01R 13/436; H01R 13/4361; H01R 13/4362; H01R 2107/00
See application file for complete search history.

(56) References Cited

U.S. PATENT DOCUMENTS 4,988,316 A * 1/1991 Roy ..... H01R 13/4361 439/744
5,199,902 A * 4/1993 Kahle ..... H01R 13/4362 439/352
(Continued)

FOREIGN PATENT DOCUMENTS

DE 19541805 A1 5/1996
DE 102004032572 A1 1/2006
DE 102007042589 A1 3/2009

OTHER PUBLICATIONS

European Patent Office, International Search Report for International Application No. PCT/EP2020/059603, dated Jul. 2, 2020.
(Continued)

*Primary Examiner* — Oscar C Jimenez
(74) *Attorney, Agent, or Firm* — Brooks Kushman P.C.

(57) ABSTRACT

A multipole electrical plug-in connector includes a plug-in connector housing and a mounting block. The plug-in connector housing has a housing base that extends perpendicular to a longitudinal axis of the plug-in connector housing. The housing base has insertion openings. Contact elements are respectively inserted through the housing base insertion openings. Each contact element has a contact portion that is connectable to a mating plug-in connector, a press-in portion, with a fir tree profile, that is pressed into the housing base insertion opening in which the contact element is inserted through, and a connection portion for connecting an electrical connection line. Each contact element further has a retaining portion between the press-in portion and the connection portion. The retaining portions of the contact elements are inter-lockingly fastened in the mounting block. A method for producing a multipole electrical plug-in connector of this type is provided.

12 Claims, 5 Drawing Sheets

(51) Int. Cl.
*H01R 13/436* (2006.01)
*H01R 107/00* (2006.01)

(56) References Cited

U.S. PATENT DOCUMENTS

| | | | | | |
|---|---|---|---|---|---|
| 5,554,055 | A * | 9/1996 | Miller | H01R 13/4362 | 439/752 |
| 5,697,814 | A | 12/1997 | Delaunay | | |
| 5,782,657 | A * | 7/1998 | Wolla | H01R 13/5221 | 439/595 |
| 6,422,903 | B1 * | 7/2002 | Fekonja | H01R 13/506 | 439/314 |
| 6,780,068 | B2 * | 8/2004 | Bartholoma | H01R 13/426 | 439/95 |
| 9,472,883 | B2 * | 10/2016 | Honnige | H01R 13/42 | |
| 10,153,595 | B2 * | 12/2018 | Quero | H01R 13/6597 | |
| 2008/0096421 | A1 | 4/2008 | Hass | | |

OTHER PUBLICATIONS

German Patent and Trademark Office, German Search Report for corresponding German Patent Application No. 10 2019 002 660.8, dated Dec. 10, 2019.

The International Bureau of WIPO, International Preliminary Report on Patentability for International Application No. PCT/EP2020/059603, dated Sep. 28, 2021.

* cited by examiner

MULTI-POLE ELECTRICAL PLUG-IN CONNECTOR

CROSS-REFERENCE TO RELATED APPLICATIONS

This application is a continuation of International Application No. PCT/EP2020/059603, published in German, with an International filing date of Apr. 3, 2020, which claims priority to DE 10 2019 002 660.8, filed Apr. 10, 2019, the disclosures of which are hereby incorporated by reference herein.

TECHNICAL FIELD

The present invention relates to a multipole electrical plug-in connector including a plug-in connector housing having a housing base that extends perpendicular to the longitudinal axis of the plug-in connector housing and that has multiple insertion openings into each of which a contact element is inserted and each contact element has a contact portion that is connectable to a mating plug-in connector, a press-in portion, with a fir tree profile, that is pressed into an insertion opening in the housing base, and an end portion having a connection portion for connecting an electrical connection line. The present invention further relates to a method for producing a multipole electrical plug-in connector of this type.

BACKGROUND

This type of electrical plug-in connector is known from German Patent Application DE 10 2007 042 589 A1. The fir tree profile (e.g., "Christmas tree" profile), integrally formed on each contact element in sections, and the pressing in of the sections into insertion openings of the housing base via the fir tree profile enable the creation of a fluid-tight plug-in connector.

The contact elements have an insertion side (e.g., plug-in side) on which they may be connected to a mating plug contact element. In the longitudinal direction opposite from the insertion side, the contact elements have a connection line side to which a connection line may be fastened, for example by crimping or soldering. The connection lines are often preassembled, i.e., connected to the contact elements before the contact elements are inserted into the plug-in connector housing.

In principle, the contact elements may be pressed into the insertion openings of the housing base from either the insertion side or from the connection line side. In each of the two cases, the fir tree profile must have a matching orientation at the contact element.

Pressing in from the insertion side is generally easier since the housing base is more accessible from the insertion side. However, it is disadvantageous that before a contact element is pressed in, the connection line to which it is already fastened must be threaded into and pulled through the associated insertion opening of the housing base. This is particularly cumbersome and time-consuming for plug-in connectors having a large number of contact elements and/or long connection lines.

Pressing in the contact elements from the connection line side avoids threading the connection lines through the insertion openings of the housing base. However, it is disadvantageous that the housing base on the connection line side is more difficult for a tool to reach in order to press in the contact elements, due to the length of the plug-in connector housing, which is usually greater on the connection line side. This is particularly true when the plug-in connector has a multipole design and therefore has a relatively large number of contact elements. Insertion of the tool is also problematic due to the number of connection lines inside the plug-in connector housing, which increases with each contact element already inserted, which makes access by the tool even more difficult.

SUMMARY

An object is to provide a generic plug-in connector that allows insertion of the contact elements from the connection line side of the plug-in connector housing while avoiding or at least reducing the disadvantages mentioned above.

Embodiments of the present invention provide a multipole electrical plug-in connector. The plug-in connector includes (i) a plug-in connector housing having a housing base and (ii) a mounting block. The housing base extends perpendicularly to the plug-in connector housing longitudinal axis and has a plurality of insertion openings. Contact elements are respectively inserted into the insertion openings. Each contact element has (i) a contact portion which can be connected to a mating plug-in connector, (ii) a press-in portion having a fir-tree profile, which press-in portion can be pressed into an insertion opening in the housing base, and (iii) at an end portion, a connection portion for connecting an electrical connection line. Each contact element further has a retaining portion between the press-in portion and the connection portion. The retaining portions of the contact elements are inter-lockingly fastened in the mounting block.

Embodiments of the present invention further provide a method for producing the multi-pole electrical plug-in connector of this type.

Embodiments of the present invention achieve the above-noted object by the contact elements each having a retaining portion between the press-in portion and the connection portion and the retaining portions of all of the contact elements being inter-lockingly fastened (e.g., form-fitted) in the mounting block.

In carrying out at least one of the above and/or other objects, a multipole electrical plug-in connector having a plug-in connector housing, a mounting block, and a plurality of contact elements is provided. The plug-in connector housing has a housing base. The housing base extends perpendicular to a longitudinal axis of the plug-in connector housing. The housing base has insertion openings. The mounting block is attached to the plug-in connector housing. The contact elements are respectively inserted through the housing base insertion openings. Each contact element has, in succession along a longitudinal direction of the contact element, a contact portion that is connectable to a mating plug-in connector, a press-in portion, with a fir tree profile, that is pressed into the housing base insertion opening in which the contact element is inserted through, and a connection portion for connecting an electrical connection line. Each contact element further has a retaining portion between the press-in portion and the connection portion. The retaining portions of the contact elements are inter-lockingly fastened in the mounting block.

In embodiments, the mounting block includes (i) a plate having insertion openings and (ii) a transverse slider that is situated at the plate and is movable perpendicularly with respect to the plate insertion openings.

The plate has insertion openings. The transverse slider has elongated holes with tapering widths to have a wider portion and a narrow portion. The plate insertion openings and the transverse slider elongated holes respectively align with one another depending on a position of the transverse slider relative to the plate. The retaining portions of the contact elements are inter-lockingly fastened in the mounting block as the contact elements are respectively inserted through corresponding pairs of plate insertion openings and transverse slider elongated holes.

In one position of the transverse slider relative to the plate, the wider portions of the transverse slider elongated holes respectively align with the plate insertion openings. In another position of the transverse slider relative to the plate, the narrow portions of the transverse slider elongated holes respectively align with the plate insertion openings.

The wider portions of the transverse slider elongated holes being respectively aligned with the plate insertion openings enables the contact elements to be inserted through corresponding pairs of plate insertion openings and transverse slider elongated holes.

In embodiments, the retaining portion of each contact element includes a circumferentially narrow section delimited on both sides by a pair of circumferentially wider collars. Diameters of the collars are smaller than cross sections of the plate insertion openings and are smaller than widths of the wider portions of the transverse slider elongated holes. A diameter of the narrow section of the retaining portion of each contact element is smaller than widths of the narrow portions of the transverse slider elongated hole. A longitudinal extension of the narrow section of the retaining portion of each contact element is less than a material thickness of the transverse slider.

In embodiments, each contact element further has a pair of collars extending in parallel in a circumferential direction, the pair of collars delimit the retaining portion of the contact element.

In embodiments, the fir tree profile of the press-in portion of each contact element is made up of multiple conically tapering molded-on elements in succession in the longitudinal direction of the contact element. The fir tree profile of the press-in portion of each contact element tapers in the longitudinal direction of the contact element from the press-in portion toward the fir tree profile so that insertion of the contact element into the housing base insertion opening in which the contact element is inserted through first takes place via the contact portion of the contact element.

Further, in carrying out at least one of the above and/or other objects, a method for producing a multipole electrical plug-in connector is provided. The method includes providing (i) a plug-in connector housing having a housing base that extends perpendicular to a longitudinal axis of the plug-in connector housing and that has insertion openings, (ii) a mounting block, and (iii) a plurality of contact elements each having, in succession along a longitudinal direction of the contact element, a contact portion that is connectable to a mating plug-in connector, a press-in portion with a fir tree profile, a retaining portion, and a connection portion for connecting an electrical connection line. The method further includes inserting the contact elements, with their contact portions leading, into the mounting block with the retaining portions of the contact elements being interlockingly fastened in the mounting block. The method further includes joining the mounting block, with the contact elements inserted thereto, to the plug-in connector housing so that the contact portions of the contact elements are respectively guided through the housing base insertion openings with the press-in portions of the contact elements being respectively pressed into the housing base insertion openings.

The method may further include connecting the connection portions of the contact elements respectively to electrical connection lines prior to joining the mounting block, with the contact elements inserted thereto, to the plug-in connector housing.

BRIEF DESCRIPTION OF THE DRAWINGS

An exemplary embodiment of the present invention is explained in greater detail below with reference to the drawings, which show the following.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
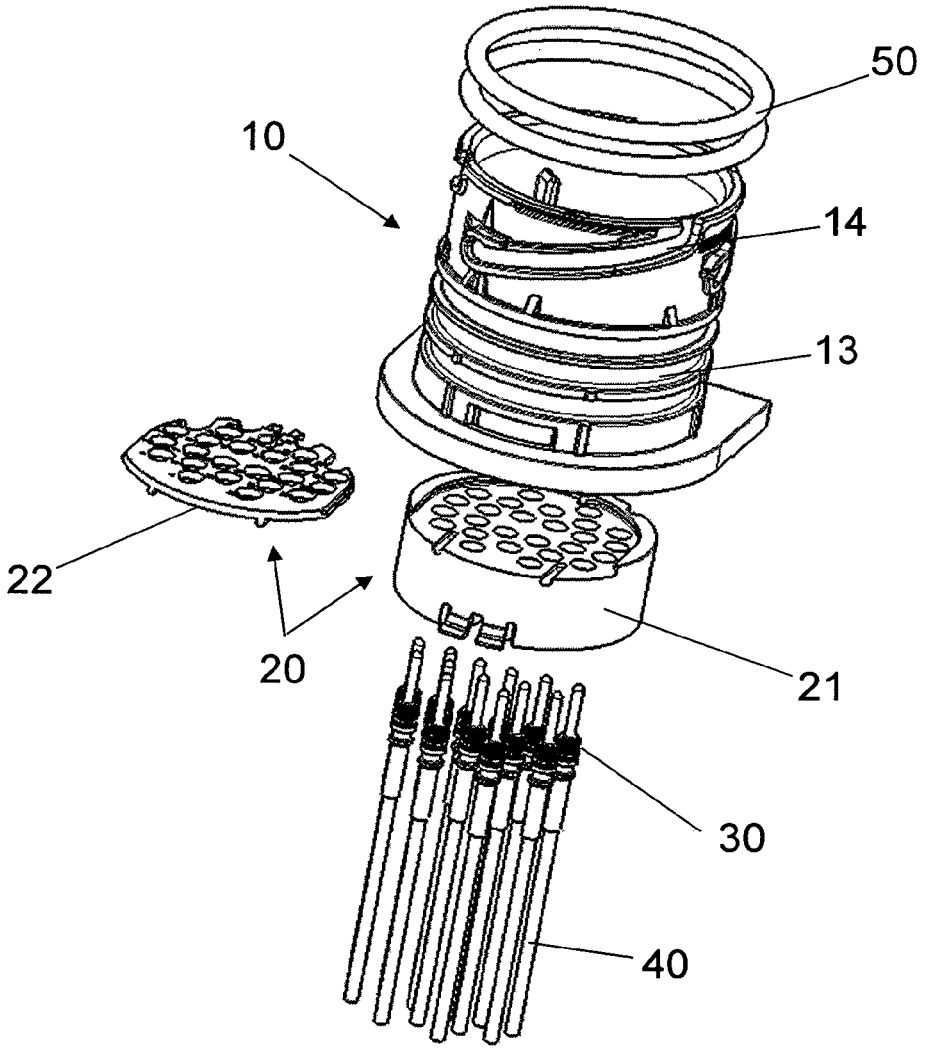
FIG. 1 illustrates an exploded view of a multipole electrical plug-in connector.

Referring now to FIG. 1, an exploded view of a multipole plug-in connector in accordance with embodiments of the present invention is shown. The multipole electrical plug-in connector includes a plug-in connector housing 10 and a mounting block 20.

Plug-in connector housing 10 has a structured outer contour. The outer contour of plug-in connector housing 10 has two annular grooves 13 and a bayonet guide 14. The two annular grooves 13 are formed in parallel to one another and are for fastening sealing rings, in particular O-rings 50. Bayonet guide 14 allows a mating plug-in connector (not shown) to be quickly and easily attached to plug-in connector housing 10 by means of a bayonet lock. O-rings 50 allow moisture-tight installation in a recess (not shown) at the intended installation point.

Figure 3:
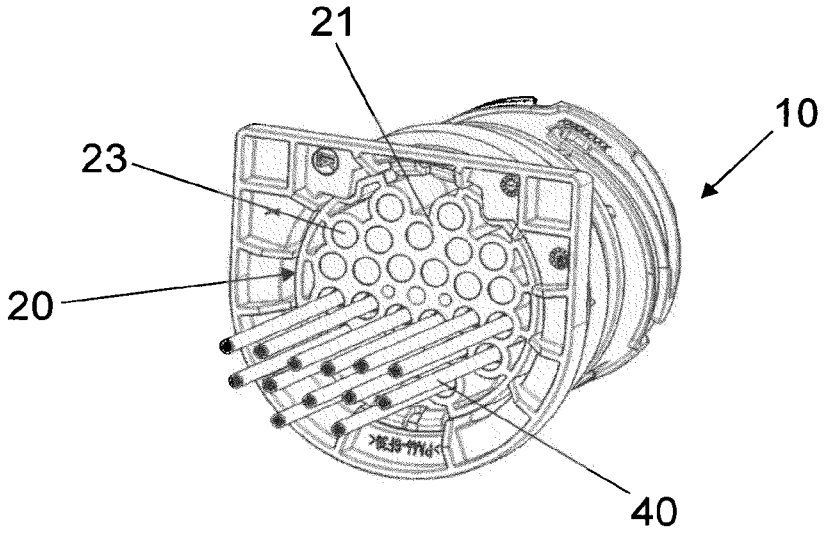
FIG. 3 illustrates a rear view of the plug-in connector.
Figure 4:
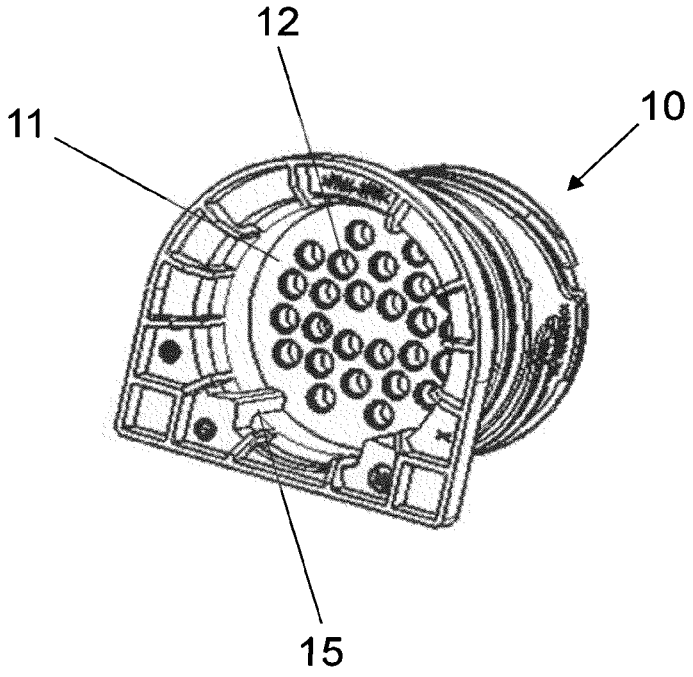
FIG. 4 illustrates a rear view of a plug-in connector housing of the plug-in connector.

Briefly turning to FIGS. 3 and 4, plug-in connector housing 10 further includes a housing base 11. Housing base 11 extends perpendicularly to a longitudinal axis of plug-in connector housing 10. Housing base 11 includes insertion openings 12. A plurality of contact elements 30 are respectively insertable through insertion openings 12 of housing base 11.

Mounting block 20 allows contact elements 30 to be fastened, which are illustrated here in each case with an electrical connection line 40 connected thereto. Mounting block 20 is positioned below plug-in connector housing 10 as indicated in FIG. 1. Mounting block 20 includes a plate 21 and a transverse slider 22. Transverse slider 22 is fastenable to plate 21 and is movable transversely with respect to plate 21.

The attachment of connection lines 40 to contact elements 30 may take place in different ways, preferably by soldering or crimping. The attachment of connection lines 40 to contact elements 30 occurs before contact elements 30 are inserted into mounting block 20.

Figure 7:
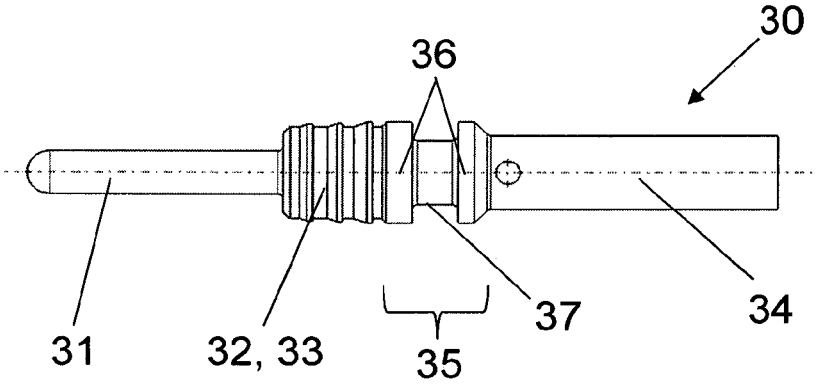
FIG. 7 illustrates a contact element as an individual part.

Briefly turning to FIG. 7, each contact element 30 has a contact portion 31 that is connectable to a mating plug-in connector, a press-in portion 32, with a fir tree profile 33, that is pressed into the insertion opening 12 of housing base 11 in which the contact element is inserted through, and a connection portion 34 for connecting a connection line 40.

Figure 2:
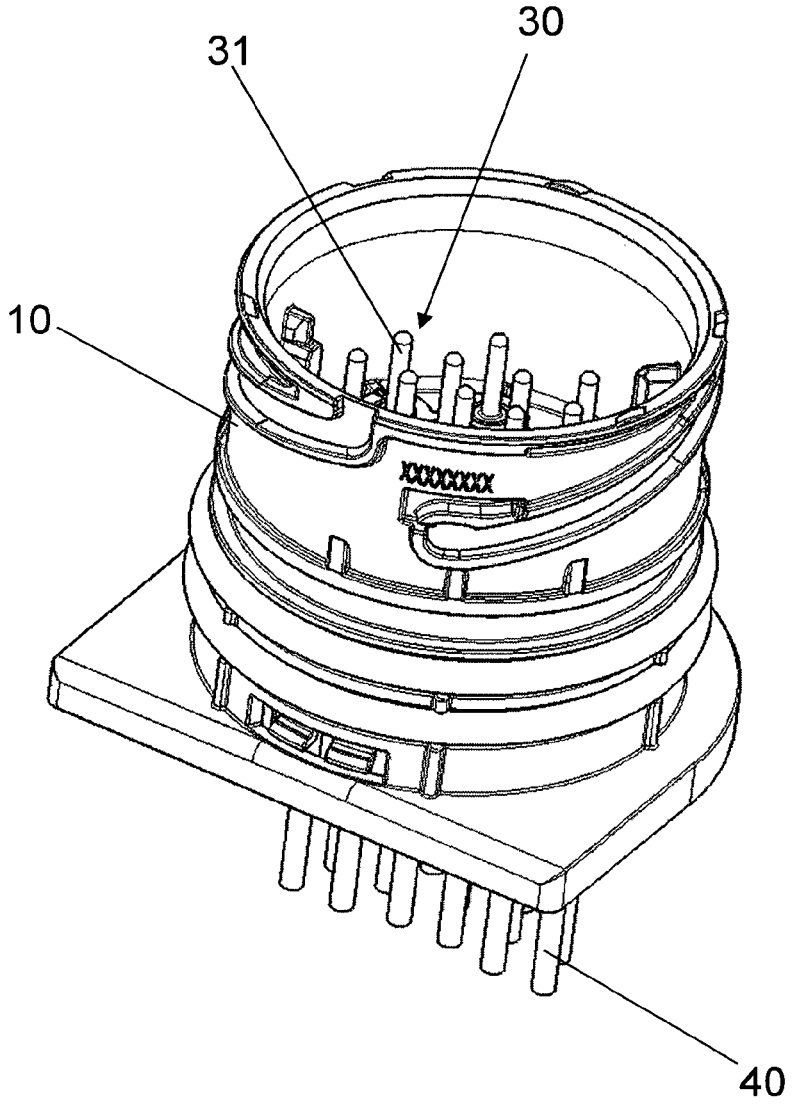
FIG. 2 illustrates the plug-in connector in the installed (i.e., assembled) state.

Referring now to FIG. 2, the completely installed multiple electrical plug-in connector is shown. Several contact portions 31 of contact elements 30 are apparent in the front opening in plug-in connector housing 10. Connection lines 40 connected to contact elements 30 are apparent at the rear side of plug-in connector housing 10.

Figure 10:
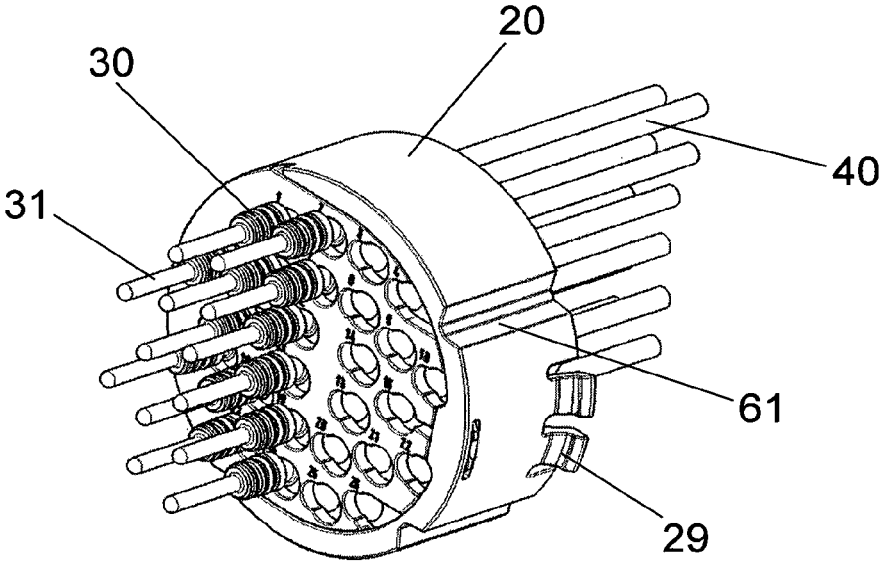
FIG. 10 illustrates the second connection state of the plate, the transverse slider, and contact elements from another perspective.

To establish this installed state, mounting block 20 fitted with contact elements 30, shown in FIG. 10, has been attached to plug-in connector housing 10 from the rear side, as shown in FIG. 3.

Plate 21 of mounting block 20 has a plurality of a plurality of insertion openings 23. In FIGS. 1, 2, and 3 and in FIGS. 8, 9, and 10, for reasons of greater clarity, insertion openings 23 of plate 21 are illustrated in each case only partially fitted with contact elements 30.

Figure 5:
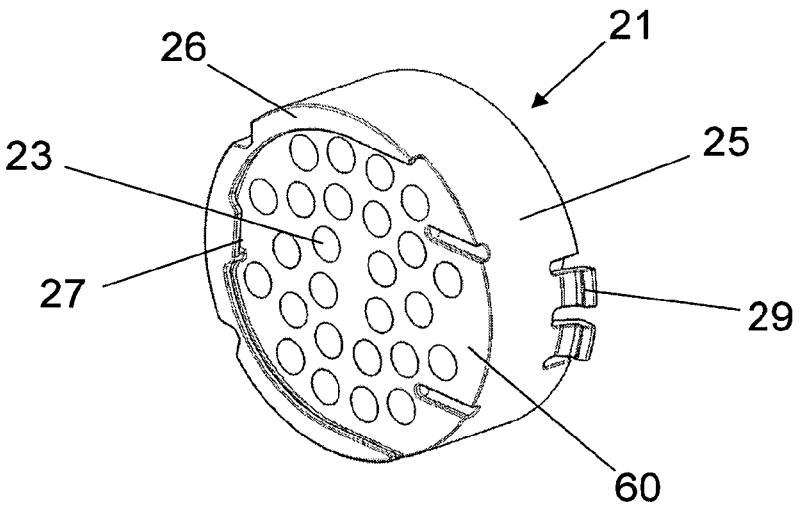
FIG. 5 illustrates a plate of a mounting block of the plug-in connector as an individual part.
Figure 6:
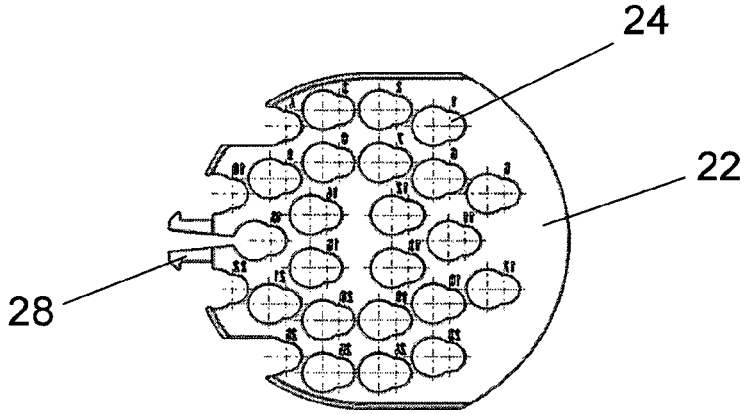
FIG. 6 illustrates a transverse slider of the mounting block of the plug-in connector as an individual part.
Figure 8:
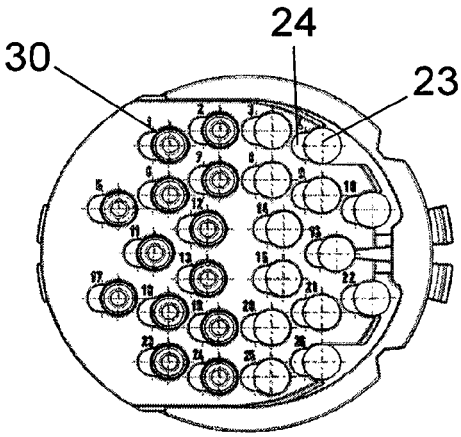
FIG. 8 illustrates a first connection state of the plate, the transverse slider, and contact elements.
Figure 9:
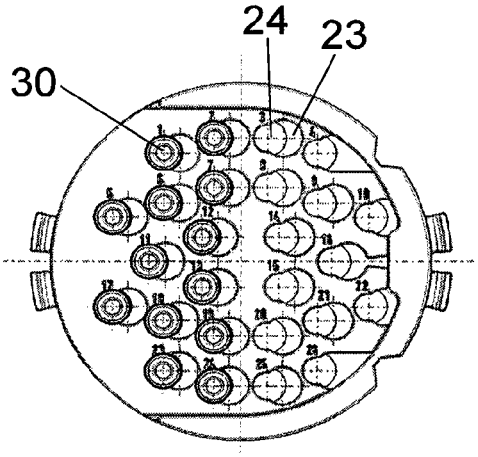
FIG. 9 illustrates a second connection state of the plate, the transverse slider, and contact elements.

For explaining the fastening of contact elements 30 in mounting block 20, in FIGS. 5, 6, and 7, plate 21, transverse slider 22, and a contact element 30 are respectively illustrated as individual parts; in FIG. 8, plate 21, transverse slider 22, and a contact element 30 are illustrated in an interconnected state; and in FIGS. 9 and 10, plate 21, transverse slider 22, and a contact element 30 are illustrated in a different interconnected state.

The number of insertion openings 23 in plate 21 corresponds to the intended number of contact elements 30 to be installed. Along its lateral (i.e., axial) circumference, plate 21 forms a wide edge portion 25, extending in the axial direction, at which elastic detent protrusions (locking projections) 29 are situated which allow locking fastening of plate 21 inside plug-in connector housing 10.

Along an end-face edge of the edge portion 25, plate 21 forms an insertion collar 26. Insertion collar 26 is situated at a distance in front of a base surface 60 of plate 21. Insertion collar 26 extends along approximately two-thirds of the circumference of plate 21 and allows transverse slider 22 to be inserted between insertion collar 26 and base surface 60 of plate 21.

Transverse slider 22, illustrated as an individual part in FIG. 6, is a flat component made of plastic into which a number of elongated holes 24 are introduced. Elongated holes 24 taper along their width, as the result of which they have an approximately keyhole-like shape.

As shown in FIGS. 8 and 9, elongated holes 24 of transverse slider 22 align with insertion openings 23 of plate 21. Depending on the position of transverse slider 22 relative to plate 21, either the wider portions (FIG. 8) or the narrower portions (FIG. 9) of elongated holes 24 of transverse slider 22 are in line with the circular insertion openings 23 in plate 21.

In the end position of transverse slider 22 illustrated in FIG. 9, detent hooks (locking hooks) 28 integrally formed on transverse slider 22 lock in a detent recess (locking recess) 27 formed by insertion collar 26 (see FIGS. 5 and 6), as a result of which the position of transverse slider 22 is subsequently fixed to plate 21. Mounting block 20 formed from plate 21 and transverse slider 22 is used to fasten multiple contact elements 30.

FIG. 7 shows a contact element 30 as an individual part. Contact element 30 has a contact portion 31, a press-in portion 32, a retaining portion 35, and a connection portion 34 in succession in the longitudinal direction. Retaining portion 35 is between press-in portion 32 and connection portion 34.

Contact portion 31, having a cylindrical design here, is used to contact a contact element, designed as a socket, of a mating plug-in connector (not shown). As an alternative to the illustration here, the contact portion may be designed as a sleeve-like contact socket that is correspondingly connectable to a pin-like contact element of a mating plug-in connector.

In addition to contact portion 31, press-in portion 32 having a so-called fir tree profile 33 is present. Fir tree profile 31 of press-in portion 32 is made up of multiple conically tapering molded-on elements in succession (e.g., successive projections) in the longitudinal direction. Fir tree profile 33 allows press-in portion 32 to be pressed into one of insertion openings 12 of housing base 11 in plug-in connector housing 10 (FIG. 4).

Fir tree profile 33 of press-in portion 32 tapers in the direction toward contact portion 31, so that the insertion of contact element 30 into insertion opening 12 of housing base 11 may first take place via contact portion 31. This is particularly advantageous due to the fact that for connection lines 40 that are preassembled with contact elements 30, connection lines 40 do not need to be threaded into and pulled through insertion openings 12 of housing base 11, which for many contact elements 30 to be installed, and possibly long connection lines 40, this would entail significant additional installation effort.

Retaining portion 35 of contact element 30, situated next to press-in portion 32, is made up of a narrow section 37, having a relatively small diameter, which is delimited on both sides by a wider integrally formed collar 36 in each case. The diameters of the two collars 36 are slightly smaller than the cross sections of insertion openings 23 in plate 21 and are likewise smaller than the broader width of elongated holes 24 in transverse slider 22. The same applies for the maximum diameter of fir tree profile 33.

In contrast, the diameter of narrow section 37 of retaining portion 35 between the two collars 36 is slightly smaller than the narrower width of elongated holes 24 in transverse slider 22. In addition, the longitudinal extension of narrow section 37 of retaining portion 35 is less than the material thickness of transverse slider 22.

It is thus possible to insert contact elements 30 into the openings in mounting block 20 when the wider portions of elongated holes 24 of transverse slider 22 are oriented in precise alignment with insertion openings 23 in plate 21. This installed state is illustrated in FIG. 8.

When all narrow sections 37 of retaining portions 35 of contact elements 30 are situated at the level of transverse slider 22, transverse slider 22 may be moved relative to plate 21 until the narrow portions of elongated holes 24 rest against narrow sections 37 of retaining portions 35 of contact elements 30. In this position of transverse slider 22, its detent hooks 28 lock with detent recesses 27 at insertion collar 26 of plate 21.

Contact elements 30 are now thus locked to mounting block 20 by transverse slider 22, since the two collars 36 of all contact elements 30 in each case are situated on both sides of the narrow portions of elongated holes 24 in transverse slider 22. The installed state thus established is illustrated in FIG. 10. FIG. 10 also shows that press-in portions 32 of contact elements 30 protrude from mounting block 20.

To install (i.e., assemble) the plug-in connector, mounting block 20, which is fitted with all intended contact elements 30, is connected to plug-in connector housing 10. Perpendicular to its longitudinal extension in the interior, plug-in connector housing 10, illustrated in FIG. 4 as an individual part, has housing base 11 with insertion openings 12, the number and configuration of which correspond to those of contact elements 30 preinstalled in mounting block 20.

The width of insertion openings 12 of housing base 11 is coordinated (e.g., matched) with the cross-sectional width of press-in portions 32 of contact elements 30, so that contact elements 30 may be fixed in each case by pressing into insertion openings 12 at housing base 11.

To install contact elements 30, the entire mounting block 20 together with contact elements 30 preinstalled thereon is attached to plug-in connector housing 10 from the rear side, so that contact portions 31 of contact elements 30 sink into insertion openings 12 in housing base 11. This positioning may be advantageously assisted by guide grooves 61 and guide bars 15 that are integrally formed on mounting block 20 and on plug-in connector housing 10, respectively.

Mounting block 20 is subsequently forcefully pressed onto plug-in connector housing 10, so that all press-in portions 32 of contact elements 30 are pressed into the associated insertion openings 12 of housing base 11 at the same time. Mounting block 20 locks in its intended end position inside plug-in connector housing 10 via integrally formed detent protrusions 29. The installed state illustrated in FIG. 3 is thus achieved, and the installation of the multipole electrical plug-in connector is concluded.

Contact portions 31 of contact elements 30 pressed into housing base 11 pass through housing base 11, and therefore are accessible from the front side of the plug-in connector, as illustrated in FIG. 2.

LIST OF REFERENCE NUMERALS

10 plug-in connector housing
11 housing base (housing bottom)
12 insertion openings
13 annular grooves
14 bayonet guide
15 guide bars
20 mounting block (assembly block)
21 plate
22 transverse slider
23 insertion openings
24 elongated holes
25 edge portion
26 insertion collar
27 detent recess (locking recess)
28 detent hook (locking hook)
29 detent protrusions (locking projections)
30 contact element
31 contact portion
32 press-in portion
33 fir tree profile
34 connection portion
35 retaining portion (mounting portion; holding portion; bracket portion)
36 collar
37 narrow portion
40 connection line
50 O-rings
60 base surface
61 guide grooves While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A multipole electrical plug-in connector comprising:

a plug-in connector housing having a housing base that extends perpendicular to a longitudinal axis of the plug-in connector housing, the housing base having insertion openings;

a mounting block attached to the plug-in connector housing, the mounting block includes (i) a plate having insertion openings and (ii) a transverse slider having elongated holes, the transverse slider is situated at the plate, and the transverse slider, independent of the plug-in connector housing, is fastened to the plate and is movable perpendicularly with respect to the plate insertion openings;

a plurality of contact elements respectively inserted through the housing base insertion openings, each contact element having, in succession along a longitudinal direction of the contact element, a contact portion that is connectable to a mating plug-in connector, a press-in portion, with a fir tree profile, that is pressed into the housing base insertion opening in which the contact element is inserted through, and a connection portion for connecting an electrical connection line;

wherein each contact element further has a retaining portion between the press-in portion and the connection portion, the retaining portion including a circumferentially narrow section delimited on both sides by a pair of circumferentially wider collars; and the retaining portions of the contact elements are interlockingly fastened in the mounting block.

2. The multipole electrical plug-in connector of claim 1 wherein:

the transverse slider elongated holes have tapering widths to have a wider portion and a narrow portion;

the plate insertion openings and the transverse slider elongated holes respectively align with one another depending on a position of the transverse slider relative to the plate; and the retaining portions of the contact elements are interlockingly fastened in the mounting block as the contact elements are respectively inserted through corresponding pairs of plate insertion openings and transverse slider elongated holes.

3. The multipole electrical plug-in connector of claim 2 wherein:

in one position of the transverse slider relative to the plate, the wider portions of the transverse slider elongated holes respectively align with the plate insertion openings; and in another position of the transverse slider relative to the plate, the narrow portions of the transverse slider elongated holes respectively align with the plate insertion openings.

4. The multipole electrical plug-in connector of claim 3 wherein:

the wider portions of the transverse slider elongated holes being respectively aligned with the plate insertion openings enables the contact elements to be inserted through corresponding pairs of plate insertion openings and transverse slider elongated holes.

5. The multipole electrical plug-in connector of claim 3 wherein:

diameters of the collars are smaller than cross sections of the plate insertion openings and are smaller than widths of the wider portions of the transverse slider elongated holes.

6. The multipole electrical plug-in connector of claim 5 wherein:

a diameter of the narrow section of the retaining portion of each contact element is smaller than widths of the narrow portions of the transverse slider elongated hole.

7. The multipole electrical plug-in connector of claim 6 wherein:

a longitudinal extension of the narrow section of the retaining portion of each contact element is less than a material thickness of the transverse slider.

8. The multipole electrical plug-in connector of claim 1 wherein:

the fir tree profile of the press-in portion of each contact element is made up of multiple conically tapering molded-on elements in succession in the longitudinal direction of the contact element.

9. The multipole electrical plug-in connector of claim 8 wherein:

the fir tree profile of the press-in portion of each contact element tapers in the longitudinal direction of the contact element from the press-in portion toward the fir tree profile so that insertion of the contact element into the housing base insertion opening in which the contact element is inserted through first takes place via the contact portion of the contact element.

10. The multipole electrical plug-in connector of claim 1 wherein:

the connection portions of the contact elements are respectively connected to electrical connection lines.

11. A method for producing a multipole electrical plug-in connector comprising:

providing a plug-in connector housing having a housing base that extends perpendicular to a longitudinal axis of the plug-in connector housing and that has insertion openings;

providing a mounting block having (i) a plate that has insertion openings and (ii) a transverse slider that has elongated holes and that is situated at the plate and that, independent of the plug-in connector housing, is fastened to the plate and is movable perpendicularly with respect to the plate insertion openings;

providing a plurality of contact elements each having, in succession along a longitudinal direction of the contact element, a contact portion that is connectable to a mating plug-in connector, a press-in portion with a fir tree profile, a retaining portion having a circumferentially narrow section delimited on both sides by a pair of circumferentially wider collars, and a connection portion for connecting an electrical connection line;

inserting the contact elements, with their contact portions leading, into the mounting block with the retaining portions of the contact elements being inter-lockingly fastened in the mounting block; and joining the mounting block, with the contact elements inserted thereto, to the plug-in connector housing so that the contact portions of the contact elements are respectively guided through the housing base insertion openings with the press-in portions of the contact elements being respectively pressed into the housing base insertion openings.

12. The method of claim 11 further comprising:

connecting the connection portions of the contact elements respectively to electrical connection lines prior to joining the mounting block, with the contact elements inserted thereto, to the plug-in connector housing.

* * * * *